US012618581B2

(12) United States Patent
Karri et al.

(10) Patent No.: US 12,618,581 B2
(45) Date of Patent: May 5, 2026

(54) SMART AIR CONTROL IN A STORAGE SPACE

(71) Applicant: International Business Machines Corporation, Armonk, NY (US)

(72) Inventors: Venkata Vara Prasad Karri, Visakhapatnam (IN); Sri Harsha Varada, Vizianagaram (IN); Sarbajit K. Rakshit, Kolkata (IN); Venkatrama Siva Kumar Vemuri, Visakhapatnam (IN)

(73) Assignee: International Business Machines Corporation, Armonk, NY (US)

( * ) Notice: Subject to any disclaimer, the term of this patent is extended or adjusted under 35 U.S.C. 154(b) by 484 days.

(21) Appl. No.: 17/656,671

(22) Filed: Mar. 28, 2022

(65) Prior Publication Data

US 2023/0304688 A1 Sep. 28, 2023

(51) Int. Cl.

| | |
|---|---|
| ***F24F 11/63*** | (2018.01) |
| ***F24F 11/46*** | (2018.01) |
| ***F24F 110/50*** | (2018.01) |

(52) U.S. Cl.

CPC ..... *F24F 11/63* (2018.01); *F24F 11/46* (2018.01); *F24F 2110/50* (2018.01)

(58) Field of Classification Search

CPC ..... F24F 11/46; F24F 11/63; F24F 2110/50
See application file for complete search history.

(56) References Cited

U.S. PATENT DOCUMENTS

| | | | | |
|---|---|---|---|---|
| 9,533,828 | B1 | 1/2017 | Dwarakanath | |
| 9,760,100 | B2 | 9/2017 | Garr | |
| 2017/0228686 | A1 | 8/2017 | Bermudez Rodriguez | |
| 2018/0137227 | A1* | 5/2018 | Ishii | G06F 30/367 |
| 2019/0174651 | A1* | 6/2019 | Crawford | H05K 7/1497 |
| 2021/0262682 | A1* | 8/2021 | Nabi | G05B 19/042 |

FOREIGN PATENT DOCUMENTS

| | | | |
|---|---|---|---|
| CN | 111197848 | A | 5/2020 |
| CN | 212081548 | U | 12/2020 |
| KR | 101812686 | B1 | 12/2017 |
| WO | 2000053980 | A1 | 9/2000 |

OTHER PUBLICATIONS

Prizer et al., How discrete event simulations can optimize your warehouse, Dec. 20, 2021, CRB Group (Year: 2020).*

"Proper Ventilation for Warehouses", The Shelving Guy Blog, Wednesday, Oct. 11, 2017, 2 pages, <https://blog.shelving.com/warehouse/proper-ventilation-for-warehouses/>.

(Continued)

*Primary Examiner* — Tameem D Siddiquee
(74) *Attorney, Agent, or Firm* — James L. Olsen

(57) ABSTRACT

A processor may receive an air dataset associated with a smart environment having one or more storage objects. The processor may simulate the smart environment using the air dataset. The processor may apply an optimization criteria to the simulation of the smart environment. The processor may generate an optimum smart environment design associated with an improved air condition level of the smart environment and the optimization criteria.

17 Claims, 5 Drawing Sheets

(56) References Cited

OTHER PUBLICATIONS

"Retail IoT smart shelf solution", WiseShelf, Printed May 17, 2021, 10 pages, <https://www.wiseshelf.com/>.
Ahmed, Bubli, "Amazon warehouse robots", YouTube, Dec. 6, 2016, 3 pages, <https://www.youtube.com/watch?v=4sEVX4mPuto>.
Greenheck. "Warehouse and Industrial Facility Ventilation Systems", YouTube, Nov. 8, 2011, 1 page, <https://www.youtube.com/watch?app=desktop&v=1b-ZURSx_jc>.
Mell, et al., "The NIST Definition of Cloud Computing", National Institute of Standards and Technology, Special Publication 800-145, Sep. 2011, 7 pages.

* cited by examiner

SMART AIR CONTROL IN A STORAGE SPACE

BACKGROUND

Aspects of the present disclosure relates generally to the field of artificial intelligence (AI), and more particularly to techniques for air quality.

Conversations about air pollutants and their effect on air quality often revolve around discussions of outdoor environments. While air pollutants associated with outdoor environments are important to consider, indoor pollutants, or those air pollutants associated with a bounded environment (e.g., a building) may also pose a significant concern for people occupying those indoor/bounded environments. In some situations, the air quality in an enclosed or bounded environment can be worse (e.g., have more pollutants) than the air quality associated with an outdoor environment or area immediately surrounding a bounded environment.

SUMMARY

Embodiments of the present disclosure include a method, computer program product, and system for optimizing worker safety in a smart environment.

A processor may receive an air dataset associated with a smart environment having one or more storage objects. The processor may simulate the smart environment using the air dataset. The processor may apply an optimization criteria to the simulation of the smart environment. The processor may generate an optimum smart environment design associated with an improved air condition level of the smart environment and the optimization criteria.

The above summary is not intended to describe each illustrated embodiment or every implementation of the present disclosure.

BRIEF DESCRIPTION OF THE DRAWINGS

The drawings included in the present disclosure are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
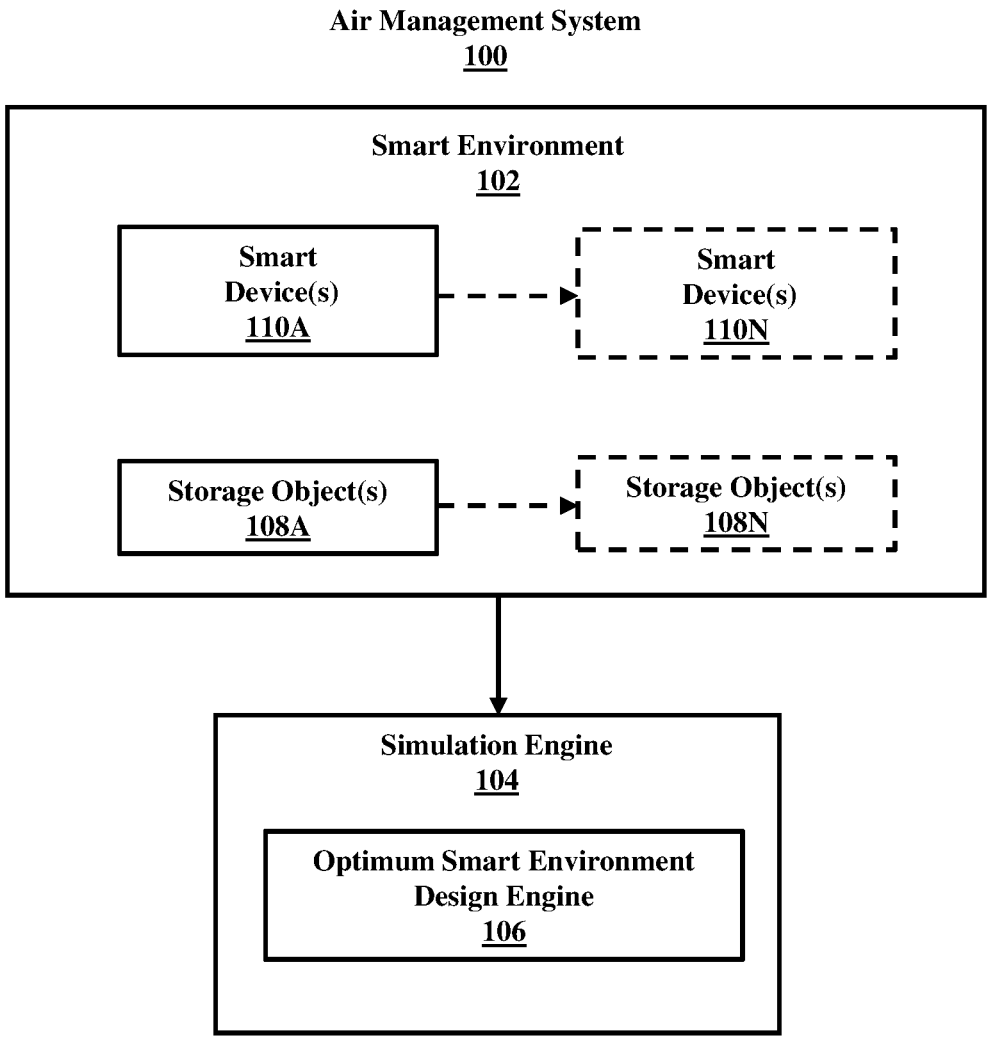
FIG. 1 illustrates a block diagram of an example air management system, in accordance with aspects of the present disclosure.

While the embodiments described herein are amenable to various modifications and alternative forms, specifics thereof have been shown by way of example in the drawings and will be described in detail. It should be understood, however, that the particular embodiments described are not to be taken in a limiting sense. On the contrary, the intention is to cover all modifications, equivalents, and alternatives falling within the spirit and scope of the disclosure.

DETAILED DESCRIPTION

Aspects of the present disclosure relate generally to the field of artificial intelligence, and more particularly to managing the air conditions of a smart environment (e.g., storage space. While the present disclosure is not necessarily limited to such applications, various aspects of the disclosure may be appreciated through a discussion of various examples using this context.

In storage spaces there can be various configurations of objects. For example, a warehouse may have a variety of shelves or racks, that may be specifically configured to hold/store various products (e.g., products that have expiration dates or need to be stored under particular conditions to maintain quality. As items are moved to or from the warehouse the amount and location of available storage space changes. For example, some products are removed from a shelf and the shelf becomes empty while other shelves within the warehouse are filled. This continuous change in the location of various products can impact how air flows throughout the warehouse. In situations where air flow is impacted, particularly in a large open space such as a warehouse, various issues may arise regarding the condition of the air (e.g., air condition). These air conditions include, but are not limited to: controlling a contaminant source (e.g., contaminants arising from materials and machinery within the warehouse), whether there is an appropriate level of fresh air within the warehouse (e.g., as dictated by worker safety standards and potential pollutants), is there sufficient air filtration to remove pollutants from the air, and whether there is an appropriate humidity management (e.g., warehouses sufficiently airconditioned to control humidity).

As such there is a desire for a solution that will ensure spaces (e.g., smart environments), such as warehouses, have sufficient air conditions despite changes in available storage space where air may or may not be able to flow.

Before turning to the FIGS. it is noted that the benefits/novelties and intricacies of the proposed solution are that:

The air management system may have Internet of Things (IoT) enabled shelves in a storage space, such as a storage space and warehouse. The air management system may use these IoT enabled shelves to identify, in real-time, storage space data. storage space data may include, but is not limited to relative position, orientation with each other, one or more empty portions or complete empty shelfs, and position of inbuilt or mobile blowers.

The air management system may be configured to identify real-time airflow and airflow paths in the storage space and if the same is effective as per the airflow movement in the warehouse.

The air management system may identify the contextual situation. For example, a contextual situation may include, but is not limited to determining that a threshold of material stored in a storage space, such as a warehouse, exceeds a capacity amount. The air management system may identify the automated systems within the storage space and the status of the automated systems. For example, the air management system may identify an automatic air-conditioning system within the warehouse (e.g., storage space) and that the automated air conditioning system is having more load due to additional material being stored within the warehouse. In such embodiments, the air management system may have self-moving shelves or racks and may be configured to arrange the self-moving shelves to allow for proper or optimized ventilation.

In embodiments where the air management system determines the airflow passage is not sufficient, the air management system may be configured to reorient or rearrange the shelves (e.g., self-moving shelves) to ensure that proper airflow can be generated within the storage space (e.g., warehouse).

The air management system may be configured to classify a human mobility path and robotic movement path inside the storage space and accordingly the shelfs of the warehouse will be reposition or reorienting inside the warehouse so that, human mobility path can proactively be ensuring fresh air movement.

In some situations, the storage space may be more or less full of stored objects (e.g., shelves may be empty, partially full, or full). Based on the amount and type of stored objects, the air management system may dynamically alter the airflow within the storage space by reconfiguring the shelving and/or how the stored objects are stored within the storage space. Based on airflow needs inside the storage space, the air management system may recommend which stored objects are to be transported from the building for delivery and which stored objects should be replenished.

The air management system may identify real-time air quality parameters (storage space data) in different locations of the storage space. The air management system may then use this information to identify how an airflow path may be generated inside the storage space. In some embodiments, the air management system may generate an airflow path inside the storage space by rearranging the storage devices (e.g., shelving).

The air management system may identify the position of various storage devices and air devices, such as mobile and built-in air blowers and self-moving shelving. Using this information, the air management system may identify how to effectively generate and maintain an airflow path throughout the storage space. For example, the air management system may enable or disable various air devices if the air management system determines that the air devices inhibit the airflow path.

In embodiments, the air management system may be configured to control the IoT enabled shelves. In some embodiments, the IoT enabled shelves may also have attached mobile blowers and exhausters on a mobile belt. These attached mobile blowers and exhausters positioned on the mobile belt may be configured to move within a particular storage device to a vacant portion of the storage device (e.g., where the storage objects are not stored). In such embodiments, the attached mobile blowers and exhausters may be configured by the air management system to aid and/or generate the airflow path through the storage space as needed.

The air management system may be configured to receive information associated with the automated systems. For example, the air management system may determine the age of the automated systems, duration of operation, amount of weather damage, whether the automated system may be automatically turned on or off. The air management system may be configured to turn on or off the automated systems if they benefit or inhibit the airflow path (e.g., based on the self-moving shelves) inside of the storage space.

Referring now to FIG. 1, illustrated is a block diagram of an air management system 100 for managing air conditions (e.g., air quality and/or airflow) in a smart environment, in accordance with aspects of the present disclosure. for controlling. FIG. 1 provides an illustration of only one implementation and does not imply any limitations with regard to the environments in which different embodiments may be implemented. Many modifications to the depicted environment may be made by those skilled in the art without departing from the scope of the invention as recited by the claims.

As depicted in FIG. 1, air management system 100 may be configured to include smart environment 102, simulation engine 104, and optimum smart environment design engine 106. In embodiments, air management system 100 may be configured to receive/collect an air dataset associated with a smart environment 102. Smart environment 102 may be any enclosed structure or building, such as a warehouse or office budling. In some embodiments, smart environment 102 may have one or more storage objects 108A-N. One or more storage objects 108A-N may be any object capable of storing objects including, but not limited to, storage shelves, storage racks, desks, filing cabinets, bookcases, etc. In embodiments, one or more storage objects 108A-N may include any number or combination of different storage objects.

In embodiments, the air dataset may be comprised of air data received/collected from a variety of sources. Air data may include any information associated with the air conditions of smart environment 102. Air data may include, but is not limited to: i) the configuration of smart environment 102 (e.g., warehouse layout and/or dimensions); ii) the number and types of storage objects 108A-N configured within smart environment 102 (e.g., number of mobile shelving units, desks, traditional shelves, etc.) currently occupying smart environment 102; iii) position of each storage object (e.g., real-time orientation/location of the storage object) within smart environment 102; iv) number and type of different products that may be stored within each storage object 108A-N; v) information associated with where a product, if one exists, is stored on/in a storage object; vi) the number of users that may occupy smart environment 102; vii) information/data generated from various analyses contemplated herein (e.g., information/data generated by AI and machine learning analysis); viii), and databases having information/data associated with the same or similar smart environments, such as how building materials or building systems, like mechanical ventilation systems (e.g., air devices and storage object devices), may impact the air condition in smart environment 102 under different circumstances.

In embodiments, air management system 100 may be configured to store air data (e.g., the air dataset) collected over time in a historical repository. The historical repository may include any air data contemplated herein. In embodiments, air management system 100 may access the historical repository to generate one or more simulations using AI and machine learning capabilities (e.g., simulation engine 104). The information generated from these analyses may be considered air data and may also be stored within the historical repository.

In embodiments, air management system 100 may receive/collect an air dataset from one or more smart devices 110A-N. Smart devices 110A-N may include, but are not limited to devices such as, Internet of Things (IoT) devices, cameras, infrared sensors, ultrasounds, chemical sensors, wearable devices (e.g., device worn into the smart environment by a user), air devices (e.g., mechanical ventilation system configured within smart environment 102), one or more storage objects 108A-N and/or storage object components (e.g., blowers, exhaust, mobile belts configured on storage object 108A to move products within the storage object), or any combination thereof. In embodiments, air management system 100 may configured smart devices 110A-N to receive/collect air data associated with the air dataset in real-time and/or to collect air data over a particular time duration. Such air data may be stored in a historical repository and accessed as needed by air management system 100 by simulation engine 104 (e.g., when using AI and machine learning capabilities performing simulations/analyses contemplated herein). While some smart devices 110A-N may be configured within the smart environment 102, other smart devices 110A-N may be configured outside and/or around the smart environment 102. For example, some smart devices 110A-N may be configured on or within the one or more storage objects 108A-N (e.g., storage object components), while other smart devices 110A-N may be positioned facing outside the smart environment to collect air data about the outside air conditions (e.g., outside air quality, outside air flow, weather, etc.). Furthermore, in some embodiments smart devices 110A-N may be configured to collect air data while in other embodiments, air management system 100 may configure some smart devices of the one or more smart devices 110A-N to perform particular actions as will be discussed herein.

In embodiments, air management system 100 may configure simulation engine 104 to generate one or more simulations of smart environment 102 using the air dataset. These simulations may be based on air data from the air dataset collected in real-time and/or collected from the historical repository. These simulations include various aspects of smart environment 102, such as how air quality (e.g., air pollutants) is affected by the configuration of smart environment 102 (e.g., positioning of storage objects), the air flow patterns throughout smart environment 102, and the various aspects that may affect the air quality and air flow patterns. In these embodiments, air management system 100 may apply an optimization criteria to the one or more simulations. The optimization criteria may refer to one or more parameters or standards that should be considered when simulating and identifying an optimum condition of the air (e.g., optimum air quality and/or optimum air flow) and optimum smart environment design of the smart environment. For example, optimization criterion may include a minimum amount of airflow throughout smart environment 102 and minimum air quality parameters, such as a minimum concentration level of a pollutant (e.g., volatile chemical compound) allotted in the air or a minimum/maximum air temperature range within smart environment 102. In some embodiments, the optimization criteria may be based on increasing energy efficiency. In some embodiments, the optimization criteria may be based on human occupied portions of smart environment 102. For example, air management system 100 may be configured to manipulate and/or increase air flow pattern to ensure portions of the smart environment traditionally (e.g., using air data associated with the historical repository) associated with human occupation receive a sufficient or optimum air flow compared to unoccupied areas of smart environment 102.

In embodiments, air management system 100 may use the simulations of smart environment 102 and determine an optimum smart environment design using simulation engine 104. In some embodiments, optimum smart environment design may be configured using optimum storage space design engine 106, a subcomponent of simulation engine 104, by analyzing air data and air data associated with the historical repository. Optimum smart environment design refer to how smart environment 102 may be reconfigured (e.g., changing the position of one storage object of the one or more storage objects 108A-N) to increase or improve air conditions within smart environment 102. Air conditions may include any parameter that may be associated with the air in smart environment 102 that may be of interest. For example, air conditions may include, but are not limited to, air quality (e.g., the concentration or amount of pollutants in the air), air flow (e.g., flow of air in and out of the smart environment), air humidity, and air temperature.

In embodiments, air management system 100 may be configured to identify (e.g., via one or more simulations using air data) one or more air devices in smart environment 102. One or more air devices may refer to devices associated with automated systems (e.g., air conditioner systems, filtration systems, ventilation systems, heating systems, etc.) as well as exhausters and blowers associated with smart environment 102. While in some embodiments, air management system 100 may be configured to identify the one or more air devices by accessing air data from a database of information associated with various aspects of smart environment 102 (e.g., type, specifications, and location of each air device), in other embodiments, air management system 100 may be configured to independently identify the type of, location of, and/or the capabilities (e.g., specifications) of each air device in smart environment 102. While in some embodiments, the one or more air devices may be stationary or fixed at a particular location within smart environment 102, in other embodiments some or all of the one or more air devices may be mobile. For example, air management system 100 may configured (e.g., instruct) the one or more air devices to move to different locations within smart environment 102 (e.g., based on the optimum smart environment design plan). In some embodiments, some or all of the air devices may be a smart device (e.g., of one or more smart device 110A-N) or have a smart device configured within the air device capable of providing air data to air management system 100. In some embodiments air management system 100 may configure/instruct air management system 100 to perform one or more actions, such as those contemplated herein.

In embodiments, air management system 100 may be configured to identify (e.g., via one or more simulations using air data) one or more storage object components in smart environment 102. Storage object components may refer to one or more components that may be configured on a storage object (e.g., large warehouse shelving unit, storage rack, etc.), such as an exhauster or blower. For example, in embodiments where a storage object is a shelving unit, the storage object may have an exhauster and/or a blower affixed (e.g., storage object component) to the shelving unit. While in some embodiments a storage object component may be a smart device (e.g., of the one or more smart devices 110A-N), in some other embodiments, a smart device may be configured within the storage object component. While in some embodiments, air management system 100 may be configured to identify the one or more storage object components by accessing air data from a database of information associated with various aspects of smart environment 102 (e.g., type, specifications, and location of each storage object component), in other embodiments, air management system 100 may be configured to independently identify the type of, location of, and/or the capabilities (e.g., specifications) of each storage object component in smart environment 102. In embodiments, air management system 100 may configure/instruct the one or more storage object components to perform one or more actions, such as those contemplated herein.

In embodiments, air management system 100 may be configured to identify (e.g., using air data from one or more smart devices 110A-N and simulation engine 104) if there are one or more products associated each of the one or more storage objects. For example, air management system 100 may identify if there is no available storage area and the storage object is filled with one or more products (e.g., no more storage space is available), if there is a portion or multiple portions of available storage area occupied with one or more products, or if the storage object is empty (e.g., no products stored). In some embodiments, the one or more storage objects 108A-N may be configured to move throughout smart environment 102 (e.g., configured to receive instructions to perform one or more actions). In embodiments, the storage objects may be configured to perform self-mobility and/or may be configured within a robotic system that may be used to mobilize the storage objects (e.g., moving shelving units from an initial position to a secondary location to increase air flow or change the pattern of air flow).

In embodiments, air management system 100 may be configured to identify the air conditions (e.g., air quality and air flow pattern) of smart environment 102. In these embodiments, air management system 100 may be configured to receive and analyze air data (e.g., using simulation engine 104) to determine what the air conditions are currently within smart environment 102. During this analyses (e.g., using one or more simulations generated by simulation engine 104), air management system 100 may determine if an how the one or more air devices, one or more storage objects (e.g., and the associated products that may be stored/housed within a storage object), the one or more storage object components, or any combination thereof, may be affecting smart environment 102. For example, air management system 100 may determine that a warehouse (e.g., smart environment 102) has multiple a large shelving units (e.g., storage objects) positioned throughout the warehouse. All of the shelving units are empty except one shelving unit that is storing the maximum amount of products (e.g., the shelving unit is full). In this example, the full shelving unit is positioned directly in front of an air conditioner system (e.g., air device) that is drawing in and cooling air from outside the warehouse. Using this example configuration, air management system 100 may analyze air data (e.g., via one or more simulations), and determine that the products stored within the full large shelving unit are preventing the flow of cool air from the air conditioner system to the rest of the warehouse (e.g., air flow pattern) and that the shelving unit's exhausters (e.g., storage object component) are further removing the generated cool air from the warehouse.

In embodiments, simulation engine 104 may quantify the air condition associated with the configuration of smart environment 102 (e.g., warehouse with a full shelving unit positioned directly in from of air conditioning unit) and identify this current state of smart environment 102's air condition (e.g., prior to generating the optimum smart environment design) as a preliminary air condition level. In embodiments, air management system 100 may uniquely identify each of the one or more storage objects, each of the one or more storage object components, each of the one or more air devices, and/or each of the one or more products that may be stored within smart environment 102.

Simulation engine 104 (e.g., optimum smart environment design engine 106) may be configured to simulate/analyze air data to identify the preliminary air condition level. The preliminary air condition level may refer to the current or simulated current air condition of smart environment 102, such as those instances associated with prior to applying the optimization criteria to the one or more simulations and/or instances where air management system 100 identifies one or more changes associated with the smart environment 102, using air data. For example, in some embodiments, air management system 100 may be configured to identify the preliminary air condition level using one or more smart devices 110A-N configured throughout and/or around the smart environment 102 to collect and analyze air data (e.g., simulation engine 104) and determine that smart environment 102 has a particular air quality and a particular air flow (e.g., air flowing through smart environment 102 in a particular pattern). Based on the one or more simulations, air management system 100 may use simulation engine 104 to determine if this preliminary air condition level can be improved upon.

In embodiments where air management system 100 may determine (e.g., via simulation engine 104) that the preliminary air condition level should be improved (e.g., based on air quality standards associated with the optimization criteria) and/or has the capability to be improved (e.g., for efficiency issues). In these embodiments, air management system 100 may generate an optimum smart environment design (e.g., optimum smart environment design engine 106). The optimum smart environment design may include one or more alterations to the smart environment 102 based on the one or more simulations and the optimization criteria (e.g., increase efficiency, improve air quality, and/or air flow pattern).

Based on the generated optimum smart environment design, air management system 100 may be configured to provide one or more instructions (e.g., instructions to storage objects, air devices, and/or storage object components) to perform one or more actions based, at least in part, on the optimum smart environment design. These actions may include, but are not limited to moving the product/storage object/storage component/air device from an initial position to a secondary position (or from an initial location to a secondary location), turning a storage object component/air device on or off, configuring the settings of the storage object component/air device to perform a particular way (e.g., configuring a blower setting from low to high), or any combination thereof. By performing one or more of the aforementioned actions associated with the optimum smart environment design, air management system 100 can manipulate and change the air conditions (e.g., air quality and/or air flow pattern) of smart environment 102. By optimizing the design or configuration of smart environment 102, the air conditions can be improved based on the optimization criteria (e.g., rules and regulations associated with air pollutants, worker safety requirements, etc.). Air management system 100 may quantify (e.g., based on one or more simulations generated using simulation engine 104) an improved air condition level for a particular design of the various optimum smart environment designs that may be generated. In embodiments, the improved air condition level will be greater than the preliminary air condition level. While in some embodiments, in order to achieve the improved air condition level, the optimum start environment design requires the one or more storage objects, storage object components, and/or air devices to perform one or more actions in concert, in other embodiments, only one or two elements (e.g., storage objects, storage object components, and/or air devices) may be instructed to perform actions in order to achieve the improved air condition level. In one example embodiment, air management system 100 may instruct a blower and an exhaust fan to change position to change the direction or pattern of airflow.

In some embodiments, air management system 100 may be configured to continuously analyze (e.g., simulate) air data (e.g., air dataset) in real-time. In some embodiments, air management system 100 may identify one or more changes associated with smart environment 102. One or more changes may include any aspect that may affect the air quality inside/outside smart environment 102 (e.g., change in the concentration of air pollutants) and/or air flow patterns throughout smart environment 102 (e.g., change in the number and/or concentration of products on the various storage objects). In embodiments where one or more changes are identified, air management system 100 may re-simulate the smart environment based on the one or more changes to identify if the air condition that was affected by the change can be improved (e.g., improved from a preliminary/changed air condition level to an improved air condition level. In such embodiments, air management system 100 may perform the various embodiments contemplated herein to generate one or more simulations to determine and update, responsive to re-simulating the smart environment, the optimum smart environment design.

In some embodiments, air management system 100 may be configured to identify air data associated with a contextual situation. For example, air management system 100 may receive air data associated with an airborne substance (e.g., pollutant or illness) that should be considered when generating the optimum smart environment design. By identifying this contextual situation, air management system 100 may ensure the optimum smart environment design includes one or more aspects that may prevent the spread of the airborne substance. For example, air management system 100 may reconfigure storage objects 108A-N, storage object components, and/or air devices to ensure the air flow pattern reduces the likelihood that a human in smart environment 102 may come into contact with the airborne substance.

In embodiments where the one or more storage objects 108A-N have one or more products stored, air management system 100 may be configured to recommend (e.g., via optimum smart environment design) which products should be removed/transported from smart environment 102 for delivery and/or where incoming products should be stored (e.g., which storage object should be used to store the product).

In embodiments, air management system 100 may use simulation engine 104 to determine the age of the one or more air devices, duration air device operation, etc. In addition, air management system 100 may be configured to determine and/or predict the effect of weather outside smart environment 102 may have on the air condition (e.g., air quality and/or air flow). For example, air management system 100 may receive air data indicating that the weather outside smart environment 102 may be used to ventilate the smart environment. In these embodiments, air management system 100 may generate an optimum smart environment design that may turn off one or more air devices and allow air external to smart environment 102 to ventilate smart environment 102.

Figure 2:
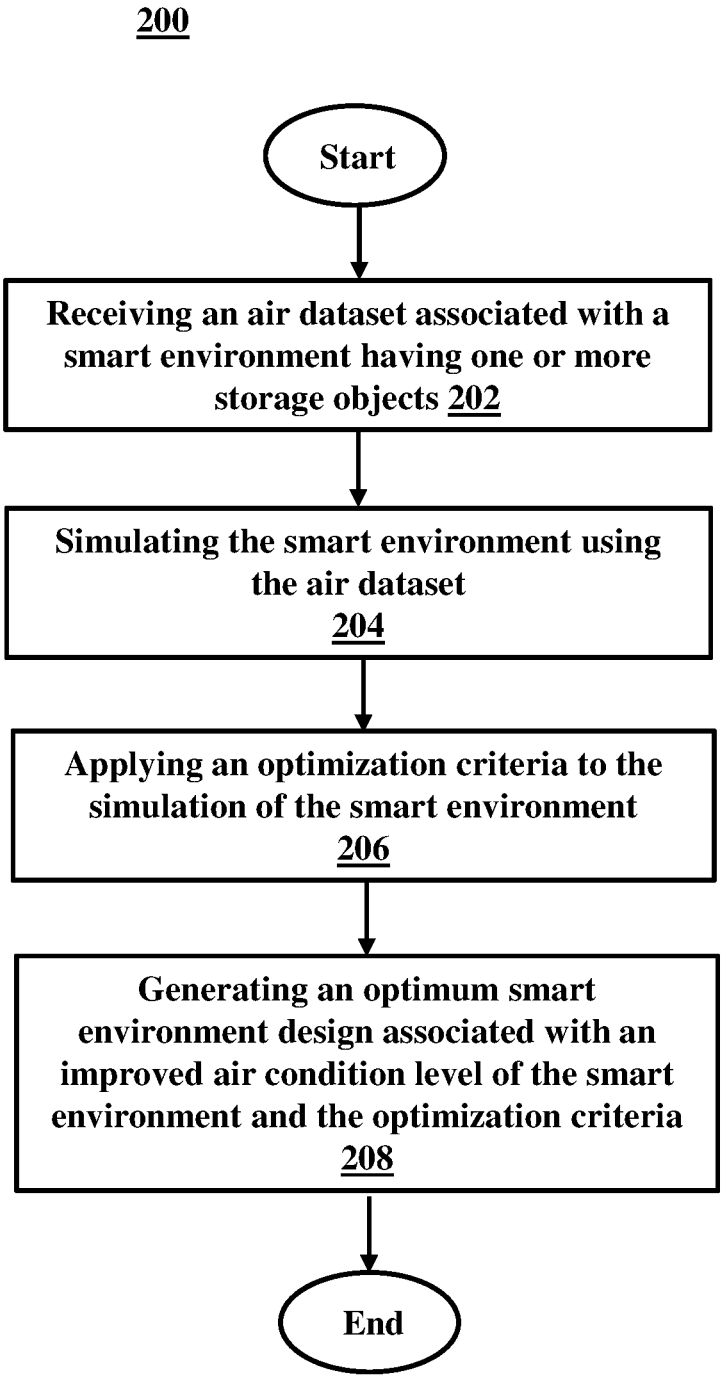
FIG. 2 illustrates a flowchart of an example method for managing air conditions in a smart environment, in accordance with aspects of the present disclosure.

Referring now to FIG. 2, a flowchart illustrating an example method 200 for managing air conditions in a smart environment, in accordance with embodiments of the present disclosure. FIG. 2 provides an illustration of only one implementation and does not imply any limitations with regard to the environments in which different embodiments may be implemented. Many modifications to the depicted environment may be made by those skilled in the art without departing from the scope of the invention as recited by the claims.

In some embodiments, the method 200 begins at operation 202 where a processor may receive an air dataset associated with a smart environment having one or more storage objects. In some embodiments, the method 200 proceeds to operation 204.

At operation 204, a processor may simulate the smart environment using the air dataset. In some embodiments, the method 200 proceeds to 206.

At operation 206, a processor may apply applying an optimization criteria to the simulation of the smart environment. In some embodiments, the method 200 may proceed to 208.

At operation 208, a processor may generate an optimum smart environment design associated with an improved air condition level of the smart environment and the optimization criteria. In some embodiments, as depicted in FIG. 2, after operation 208, the method 200 may end.

In some embodiments, discussed below there are one or more operations of the method 200 not depicted for the sake of brevity and which are discussed throughout this disclosure. Accordingly, in some embodiments, the processor may alter the smart environment. The processor may base this alteration on the optimum smart environment design. In some embodiments, altering may include moving at least one storage object of the one or more storage objects from an initial position to a new or secondary position.

In some embodiments, a processor may identify one or more air devices in the smart environment. In these embodiments, a processor may instruct the one or more air devices in the smart environment to perform an action based, at least in part, on the one or more simulations and the optimization criteria. The action may be associated with the optimum smart environment design.

In some embodiments, the processor may analyze the air dataset in real-time for one or more changes in the smart environment. In these embodiments, the processor may re-simulate the smart environment based on the one or more changes. The processor may then update, responsive to re-simulating the smart environment, the optimum smart environment design.

In some embodiments, the improved air condition level is greater than a preliminary air condition level.

In some embodiments, the processor may identify one or more storage object components associated with the one or more storage objects in the smart environment. The processor may instruct the one or more storage object components based, at least in part, on the one or more simulations and the optimization criteria. Instructing the one or more storage object components are associated with the optimum smart environment design.

In some embodiments, the processor may identify one or more products are associated with the one or more storage objects. The processor may arrange the one or more products on the one or more storage object components from an initial location to a secondary location. Arranging the one or more products is associated with the optimum smart environment design.

It is to be understood that although this disclosure includes a detailed description on cloud computing, implementation of the teachings recited herein are not limited to a cloud computing environment. Rather, embodiments of the present disclosure are capable of being implemented in conjunction with any other type of computing environment now known or later developed.

Cloud computing is a model of service delivery for enabling convenient, on-demand network access to a shared pool of configurable computing resources (e.g., networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of portion independence in that the consumer generally has no control or knowledge over the exact portion of the provided resources but may be able to specify portion at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported, providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure that includes a network of interconnected nodes.

Figure 3A:
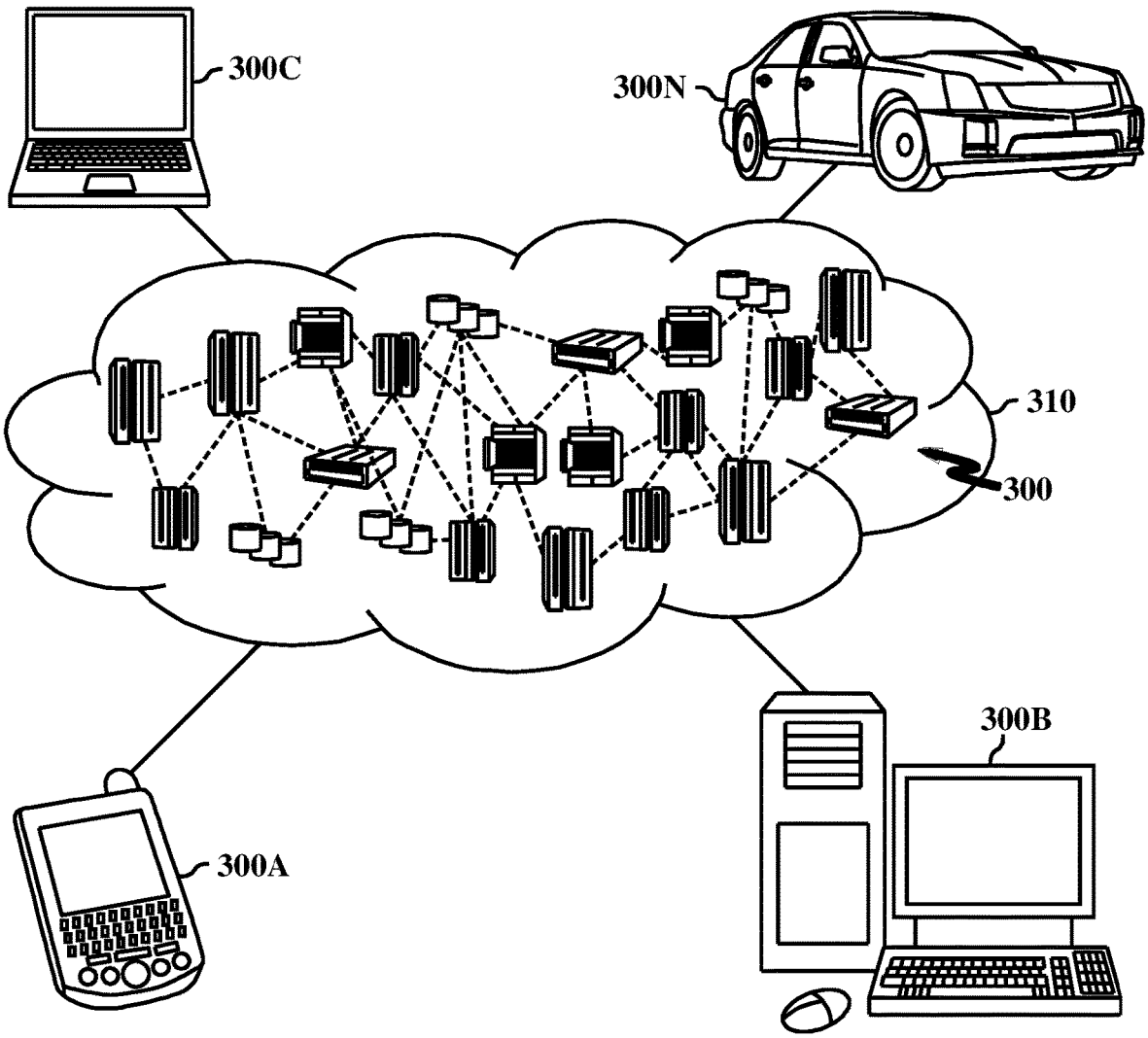
FIG. 3A illustrates a cloud computing environment, in accordance with aspects of the present disclosure.

FIG. 3A, illustrated is a cloud computing environment 310 is depicted. As shown, cloud computing environment 310 includes one or more cloud computing nodes 300 with which local computing devices used by cloud consumers, such as, for example, personal digital assistant (PDA) or cellular telephone 300A, desktop computer 300B, laptop computer 300C, and/or automobile computer system 300N may communicate. Nodes 300 may communicate with one another. They may be grouped (not shown) physically or virtually, in one or more networks, such as Private, Community, Public, or Hybrid clouds as described hereinabove, or a combination thereof.

This allows cloud computing environment 310 to offer infrastructure, platforms and/or software as services for which a cloud consumer does not need to maintain resources on a local computing device. It is understood that the types of computing devices 300A-N shown in FIG. 3A are intended to be illustrative only and that computing nodes 300 and cloud computing environment 310 can communicate with any type of computerized device over any type of network and/or network addressable connection (e.g., using a web browser).

Figure 3B:
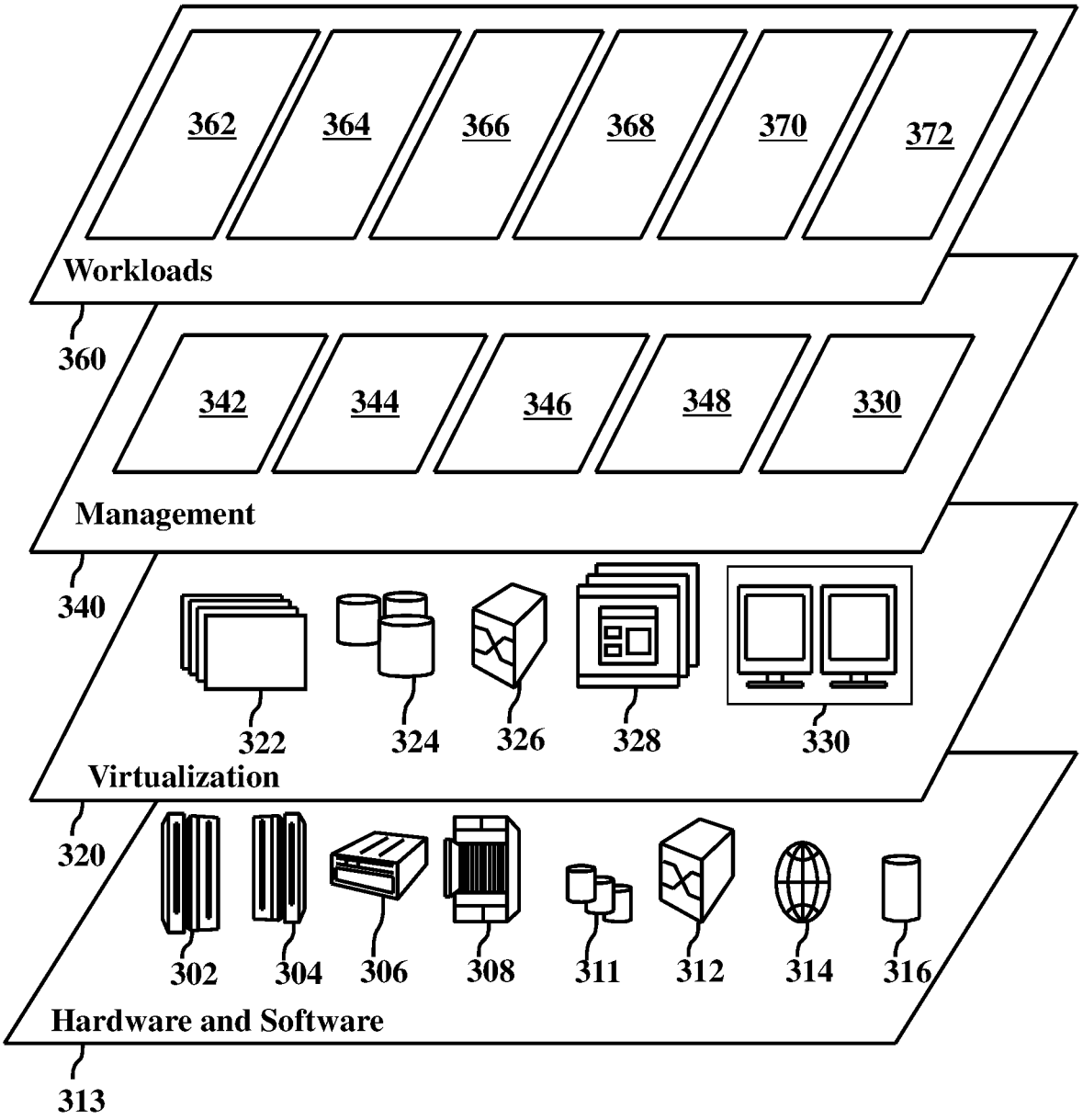
FIG. 3B illustrates abstraction model layers, in accordance with aspects of the present disclosure.

FIG. 3B, illustrated is a set of functional abstraction layers provided by cloud computing environment 310 (FIG. 3A) is shown. It should be understood in advance that the components, layers, and functions shown in FIG. 3B are intended to be illustrative only and embodiments of the disclosure are not limited thereto. As depicted below, the following layers and corresponding functions are provided.

Hardware and software layer 315 includes hardware and software components. Examples of hardware components include: mainframes 302; RISC (Reduced Instruction Set Computer) architecture based servers 304; servers 306; blade servers 308; storage devices 311; and networks and networking components 312. In some embodiments, software components include network application server software 314 and database software 316.

Virtualization layer 320 provides an abstraction layer from which the following examples of virtual entities may be provided: virtual servers 322; virtual storage 324; virtual networks 326, including virtual private networks; virtual applications and operating systems 328; and virtual clients 330.

In one example, management layer 340 may provide the functions described below. Resource provisioning 342 provides dynamic procurement of computing resources and other resources that are utilized to perform tasks within the cloud computing environment. Metering and Pricing 344 provide cost tracking as resources are utilized within the cloud computing environment, and billing or invoicing for consumption of these resources. In one example, these resources may include application software licenses. Security provides identity verification for cloud consumers and tasks, as well as protection for data and other resources. User portal 346 provides access to the cloud computing environment for consumers and system administrators. Service level management 348 provides cloud computing resource allocation and management such that required service levels are met. Service Level Agreement (SLA) planning and fulfillment 350 provide pre-arrangement for, and procurement of, cloud computing resources for which a future requirement is anticipated in accordance with an SLA.

Workloads layer 360 provides examples of functionality for which the cloud computing environment may be utilized. Examples of workloads and functions which may be provided from this layer include: mapping and navigation 362; software development and lifecycle management 364; virtual classroom education delivery 366; data analytics processing 368; transaction processing 370; and air condition manager 372.

Figure 4:
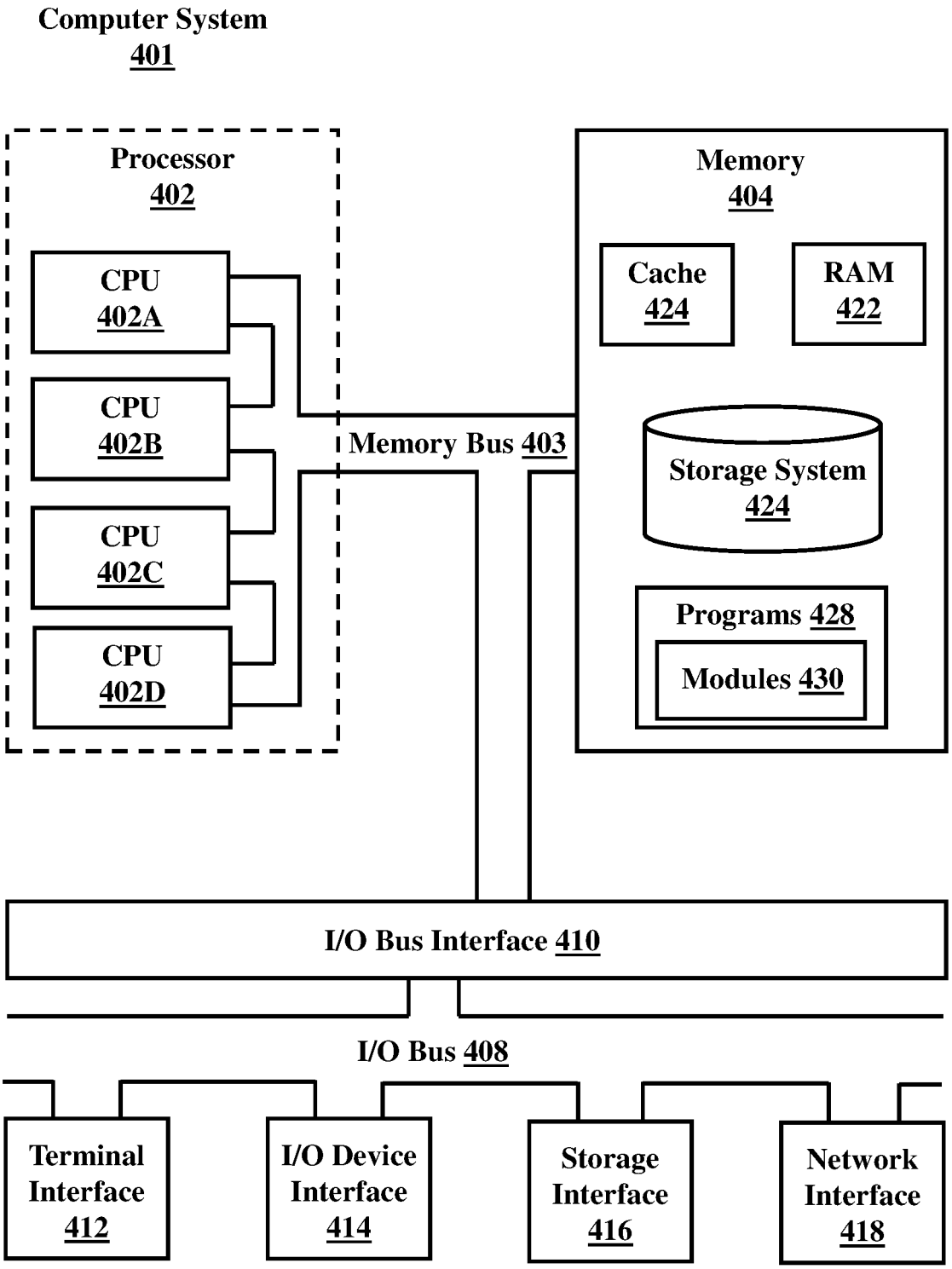
FIG. 4 illustrates a high-level block diagram of an example computer system that may be used in implementing one or more of the methods, tools, and modules, and any related functions, described herein, in accordance with aspects of the present disclosure.

FIG. 4, illustrated is a high-level block diagram of an example computer system 401 that may be used in implementing one or more of the methods, tools, and modules, and any related functions, described herein (e.g., using one or more processor circuits or computer processors of the computer), in accordance with embodiments of the present disclosure. In some embodiments, the major components of the computer system 401 may comprise one or more CPUs 402, a memory subsystem 404, a terminal interface 412, a storage interface 416, an I/O (Input/Output) device interface 414, and a network interface 418, all of which may be communicatively coupled, directly or indirectly, for inter-component communication via a memory bus 403, an I/O bus 408, and an I/O bus interface unit 410.

The computer system 401 may contain one or more general-purpose programmable central processing units (CPUs) 402A, 402B, 402C, and 402D, herein generically referred to as the CPU 402. In some embodiments, the computer system 401 may contain multiple processors typical of a relatively large system; however, in other embodiments the computer system 401 may alternatively be a single CPU system. Each CPU 402 may execute instructions stored in the memory subsystem 404 and may include one or more levels of on-board cache.

System memory 404 may include computer system readable media in the form of volatile memory, such as random access memory (RAM) 422 or cache memory 424. Computer system 401 may further include other removable/non-removable, volatile/non-volatile computer system storage media. By way of example only, storage system 426 can be provided for reading from and writing to a non-removable, non-volatile magnetic media, such as a "hard drive." Although not shown, a magnetic disk drive for reading from and writing to a removable, non-volatile magnetic disk (e.g., a "floppy disk"), or an optical disk drive for reading from or writing to a removable, non-volatile optical disc such as a CD-ROM, DVD-ROM or other optical media can be provided. In addition, memory 404 can include flash memory, e.g., a flash memory stick drive or a flash drive. Memory devices can be connected to memory bus 403 by one or more data media interfaces. The memory 404 may include at least one program product having a set (e.g., at least one) of program modules that are configured to carry out the functions of various embodiments.

One or more programs/utilities 428, each having at least one set of program modules 430 may be stored in memory 404. The programs/utilities 428 may include a hypervisor (also referred to as a virtual machine monitor), one or more operating systems, one or more application programs, other program modules, and program data. Each of the operating systems, one or more application programs, other program modules, and program data or some combination thereof, may include an implementation of a networking environment. Programs 428 and/or program modules 430 generally perform the functions or methodologies of various embodiments.

Although the memory bus 403 is shown in FIG. 4 as a single bus structure providing a direct communication path among the CPUs 402, the memory subsystem 404, and the I/O bus interface 410, the memory bus 403 may, in some embodiments, include multiple different buses or communication paths, which may be arranged in any of various forms, such as point-to-point links in hierarchical, star or web configurations, multiple hierarchical buses, parallel and redundant paths, or any other appropriate type of configuration. Furthermore, while the I/O bus interface 410 and the I/O bus 408 are shown as single respective units, the computer system 401 may, in some embodiments, contain multiple I/O bus interface units 410, multiple I/O buses 408, or both. Further, while multiple I/O interface units are shown, which separate the I/O bus 408 from various communications paths running to the various I/O devices, in other embodiments some or all of the I/O devices may be connected directly to one or more system I/O buses.

In some embodiments, the computer system 401 may be a multi-user mainframe computer system, a single-user system, or a server computer or similar device that has little or no direct user interface, but receives requests from other computer systems (clients). Further, in some embodiments, the computer system 401 may be implemented as a desktop computer, portable computer, laptop or notebook computer, tablet computer, pocket computer, telephone, smartphone, network switches or routers, or any other appropriate type of electronic device.

It is noted that FIG. 4 is intended to depict the representative major components of an exemplary computer system 401. In some embodiments, however, individual components may have greater or lesser complexity than as represented in FIG. 4, components other than or in addition to those shown in FIG. 4 may be present, and the number, type, and configuration of such components may vary.

As discussed in more detail herein, it is contemplated that some or all of the operations of some of the embodiments of methods described herein may be performed in alternative orders or may not be performed at all; furthermore, multiple operations may occur at the same time or as an internal part of a larger process.

The present disclosure may be a system, a method, and/or a computer program product at any possible technical detail level of integration. The computer program product may include a computer readable storage medium (or media) having computer readable program instructions thereon for causing a processor to carry out aspects of the present disclosure.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present disclosure may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present disclosure.

Aspects of the present disclosure are described herein with reference to flowchart illustrations and/or block diagrams of methods, apparatus (systems), and computer program products according to embodiments of the disclosure. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present disclosure. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be accomplished as one step, executed concurrently, substantially concurrently, in a partially or wholly temporally overlapping manner, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Although the present disclosure has been described in terms of specific embodiments, it is anticipated that alterations and modification thereof will become apparent to the skilled in the art. Therefore, it is intended that the following claims be interpreted as covering all such alterations and modifications as fall within the true spirit and scope of the disclosure.

What is claimed is:

1. A computer-implemented method comprising:

receiving, by a processor, an air dataset associated with a smart environment having one or more storage objects, the one or more storage objects configured within a robotic system used to mobilize the one or more storage objects;

simulating the smart environment using the air dataset;

applying an optimization criteria to the simulation of the smart environment, wherein the optimization criteria include an airflow criterion specifying a minimum airflow within the smart environment and an air quality criterion specifying an allotted concentration level of a chemical compound;

generating an optimum smart environment design associated with an improved air condition level of the smart environment and the optimization criteria; and altering the smart environment based on the optimum smart environment design, wherein altering includes causing the robotic system to move at least one storage object of the one or more storage objects from an initial position to a secondary position.

2. The method of claim 1, further comprising:

identifying one or more air devices in the smart environment; and instructing the one or more air devices in the smart environment to perform an action based, at least in part, on the one or more simulations and the optimization criteria, wherein the action is associated with the optimum smart environment design.

3. The method of claim 1, further comprising:

analyzing the air dataset in real-time for one or more changes in the smart environment;

re-simulating the smart environment based on the one or more changes; and updating, responsive to re-simulating the smart environment, the optimum smart environment design.

4. The method of claim 1, wherein the improved air condition level is greater than a preliminary air condition level.

5. The method of claim 1, further comprising:

identifying one or more storage object components associated with the one or more storage objects in the smart environment; and instructing the one or more storage object components based, at least in part, on the one or more simulations and the optimization criteria, wherein instructing the one or more storage object components are associated with the optimum smart environment design.

6. The method of claim 5, wherein instructing the one or more storage object components includes:

identifying one or more products are associated with the one or more storage objects; and arranging the one or more products on the one or more storage object components from an initial location to a secondary location, wherein arranging the one or more products is associated with the optimum smart environment design.

7. A system comprising:

a memory; and a processor in communication with the memory, the processor being configured to perform operations comprising:

receiving an air dataset associated with a smart environment having one or more storage objects, the one or more storage objects configured within a robotic system used to mobilize the one or more storage objects;

simulating the smart environment using the air dataset;

applying an optimization criteria to the simulation of the smart environment, wherein the optimization criteria include an airflow criterion specifying a minimum airflow within the smart environment and an air quality criterion specifying an allotted concentration level of a chemical compound;

generating an optimum smart environment design associated with an improved air condition level of the smart environment and the optimization criteria; and altering the smart environment based on the optimum smart environment design, wherein altering includes causing the robotic system to move at least one storage object of the one or more storage objects from an initial position to a secondary position.

8. The system of claim 7, further comprising:

identifying one or more air devices in the smart environment; and instructing the one or more air devices in the smart environment to perform an action based, at least in part, on the one or more simulations and the optimization criteria, wherein the action is associated with the optimum smart environment design.

9. The system of claim 7, further comprising:

analyzing the air dataset in real-time for one or more changes in the smart environment;

re-simulating the smart environment based on the one or more changes; and updating, responsive to re-simulating the smart environment, the optimum smart environment design.

10. The system of claim 7, wherein the improved air condition level is greater than a preliminary air condition level.

11. The system of claim 7, further comprising:

identifying one or more storage object components associated with the one or more storage objects in the smart environment; and instructing the one or more storage object components based, at least in part, on the one or more simulations and the optimization criteria, wherein instructing the one or more storage object components are associated with the optimum smart environment design.

12. The system of claim 11, wherein instructing the one or more storage object components includes:

identifying one or more products are associated with the one or more storage objects; and arranging the one or more products on the one or more storage object components from an initial location to a secondary location, wherein arranging the one or more products is associated with the optimum smart environment design.

13. A computer program product comprising a computer readable storage medium having program instructions embodied therewith, the program instructions executable by a processor to cause the processor to perform operations, the operations comprising:

receiving an air dataset associated with a smart environment having one or more storage objects, the one or more storage objects configured within a robotic system used to mobilize the one or more storage objects;

simulating the smart environment using the air dataset;

applying an optimization criteria to the simulation of the smart environment, wherein the optimization criteria include an airflow criterion specifying a minimum airflow within the smart environment and an air quality criterion specifying an allotted concentration level of a chemical compound;

generating an optimum smart environment design associated with an improved air condition level of the smart environment and the optimization criteria; and altering the smart environment based on the optimum smart environment design, wherein altering includes causing the robotic system to move at least one storage object of the one or more storage objects from an initial position to a secondary position.

14. The computer program product of claim 13, further comprising:

identifying one or more air devices in the smart environment; and instructing the one or more air devices in the smart environment to perform an action based, at least in part, on the one or more simulations and the optimization criteria, wherein the action is associated with the optimum smart environment design.

15. The computer program product of claim 13, further comprising:

analyzing the air dataset in real-time for one or more changes in the smart environment;

re-simulating the smart environment based on the one or more changes; and updating, responsive to re-simulating the smart environment, the optimum smart environment design.

16. The computer program product of claim 13, further comprising:

identifying one or more storage object components associated with the one or more storage objects in the smart environment; and instructing the one or more storage object components based, at least in part, on the one or more simulations and the optimization criteria, wherein instructing the one or more storage object components are associated with the optimum smart environment design.

17. The computer program product of claim 16, wherein instructing the one or more storage object components includes:

identifying one or more products are associated with the one or more storage objects; and arranging the one or more products on the one or more storage object components from an initial location to a secondary location, wherein arranging the one or more products is associated with the optimum smart environment design.

* * * * *